US010808568B2

(12) United States Patent
Dyer et al.

(10) Patent No.: US 10,808,568 B2
(45) Date of Patent: Oct. 20, 2020

(54) AIRFOIL ASSEMBLY FOR A GAS TURBINE ENGINE

(71) Applicant: United Technologies Corporation, Farmington, CT (US)

(72) Inventors: David M. Dyer, Glastonbury, CT (US); Michael Ronan, Glastonbury, CT (US); Kevin Knechtel, Amston, CT (US)

(73) Assignee: RAYTHEON TECHNOLOGIES CORPORATION, Farmington, CT (US)

( * ) Notice: Subject to any disclaimer, the term of this patent is extended or adjusted under 35 U.S.C. 154(b) by 175 days.

(21) Appl. No.: 16/128,911

(22) Filed: Sep. 12, 2018

(65) Prior Publication Data

US 2020/0080442 A1 Mar. 12, 2020

(51) Int. Cl.

| | |
|---|---|
| ***F01D 17/16*** | (2006.01) |
| ***F04D 29/54*** | (2006.01) |
| ***F04D 29/56*** | (2006.01) |
| ***F01D 9/04*** | (2006.01) |

(52) U.S. Cl.

CPC ..... *F01D 17/162* (2013.01); *F01D 9/041* (2013.01); *F04D 29/544* (2013.01); *F04D 29/563* (2013.01); *F05D 2240/12* (2013.01)

(58) Field of Classification Search

CPC ..... F01D 17/162; F04D 29/56; F04D 29/563
See application file for complete search history.

(56) References Cited

U.S. PATENT DOCUMENTS

| | | | | |
|---|---|---|---|---|
| 3,352,537 | A * | 11/1967 | Petrie | F01D 17/162 60/39.01 |
| 4,050,844 | A | 9/1977 | Miller et al. | |
| 4,821,758 | A * | 4/1989 | Ruis | F01D 17/162 137/15.1 |
| 5,062,767 | A * | 11/1991 | Worley | F01D 9/042 415/190 |
| 5,796,199 | A | 8/1998 | Charbonnel | |
| 6,010,304 | A | 1/2000 | Moniz | |
| 6,129,512 | A | 10/2000 | Agram | |
| 7,223,066 | B2 | 5/2007 | Rockley | |
| 7,753,647 | B2 * | 7/2010 | Giaimo | F01D 17/162 415/160 |
| 9,617,864 | B2 * | 4/2017 | Firnhaber | F01D 17/162 |
| 9,932,988 | B2 * | 4/2018 | Maliniak | F01D 17/162 |
| 2010/0329836 | A1 | 12/2010 | Edmondson | |

FOREIGN PATENT DOCUMENTS

| | | |
|---|---|---|
| FR | 2956454 | 8/2011 |

OTHER PUBLICATIONS

EP Search Report for EP Application No. 19196923.7 dated Jan. 24, 2020.

* cited by examiner

*Primary Examiner* — Kenneth J Hansen
*Assistant Examiner* — Brian O Peters
(74) *Attorney, Agent, or Firm* — Carlson, Gaskey & Olds, P.C.

(57) ABSTRACT

A vane assembly includes a rotatable airfoil that extends between a radially inner platform and a radially outer platform and has a leading edge and a trailing edge. A thrust projection is fixed relative to the rotatable airfoil. The thrust projection includes a first thrust surface for supporting radial loads in a first radial direction and a second thrust surface for supporting radial loads in a second direction.

20 Claims, 4 Drawing Sheets

AIRFOIL ASSEMBLY FOR A GAS TURBINE ENGINE

STATEMENT REGARDING FEDERALLY SPONSORED RESEARCH OR DEVELOPMENT

This invention was made with Government support awarded by the United States. The Government has certain rights in this invention.

BACKGROUND

A gas turbine engine typically includes a fan section, a compressor section, a combustor section, and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. As the gases pass through the gas turbine engine, they pass over rows of vanes and rotors. In order to improve the operation of the gas turbine engine during different operating conditions, an orientation of some of the vanes and/or rotors may vary to accommodate current conditions.

SUMMARY

In one exemplary embodiment, a vane assembly includes a rotatable airfoil that extends between a radially inner platform and a radially outer platform and has a leading edge and a trailing edge. A thrust projection is fixed relative to the rotatable airfoil. The thrust projection includes a first thrust surface for supporting radial loads in a first radial direction and a second thrust surface for supporting radial loads in a second direction.

In a further embodiment of any of the above, the rotatable airfoil is rotatable about an axis that extends through the rotatable airfoil and a center of the thrust projection.

In a further embodiment of any of the above, the first thrust surface is a radially outer surface and the second thrust surface is a radially inner surface. The first thrust surface is connected to the second thrust surface by a cylindrical portion.

In a further embodiment of any of the above, a radially outer projection on the rotatable airfoil has a cylindrical cross-section.

In a further embodiment of any of the above, the radially outer projection extends through an opening in at least one of the radially outer platform or an engine case.

In a further embodiment of any of the above, the rotatable airfoil is rotatable relative to the radially outer platform and the radially inner platform.

In a further embodiment of any of the above, a fixed airfoil portion extends between the radially inner platform and the radially outer platform and has a leading edge and a trailing edge. The rotatable airfoil is located aft of the fixed airfoil portion. The trailing edge of the fixed airfoil portion includes a concave surface.

In a further embodiment of any of the above, the trailing edge of the fixed airfoil portion includes a first edge adjacent a pressure side of the fixed airfoil portion and a second edge adjacent a suction side of the fixed airfoil portion. The first edge and the second edge define boundaries of the concave surface.

In a further embodiment of any of the above, the leading edge of the rotatable airfoil is convex and follows a profile of the concave surface on the fixed airfoil portion.

In another exemplary embodiment, a gas turbine engine includes a compressor section driven by a turbine section. The compressor section includes a vane assembly that has a rotatable airfoil that extends between a radially inner platform and a radially outer platform that have a leading edge and a trailing edge. A thrust projection is fixed relative to the rotatable airfoil. The thrust projection includes a first thrust surface for supporting radial loads in a first radial direction and a second thrust surface for supporting radial loads in a second radial direction.

In a further embodiment of any of the above, the rotatable airfoil is rotatable about an axis that extends through the rotatable airfoil and a center of the thrust projection.

In a further embodiment of any of the above, the first thrust surface is a radially outer surface and the second thrust surface is a radially inner surface. The first thrust surface is connected to the second thrust surface by a cylindrical portion.

In a further embodiment of any of the above, a radially outer projection on the rotatable airfoil has a cylindrical cross-section.

In a further embodiment of any of the above, the radially outer projection extends through an opening in at least one of the radially outer platform or an engine case.

In a further embodiment of any of the above, the rotatable airfoil is rotatable relative to the radially outer platform and the radially inner platform.

In a further embodiment of any of the above, a fixed airfoil portion extends between the radially inner platform and the radially outer platform and has a leading edge and a trailing edge. The rotatable airfoil is located aft of the fixed airfoil portion. The trailing edge of the fixed airfoil portion includes a concave surface. The trailing edge of the fixed airfoil portion includes a first edge adjacent a pressure side of the fixed airfoil portion and a second edge adjacent a suction side of the fixed airfoil portion. The first edge and the second edge define boundaries of the concave surface.

In a further embodiment of any of the above, the leading edge of the rotatable airfoil is convex and follows a profile of the concave surface on the fixed airfoil portion.

In one exemplary embodiment, a method of controlling radial loads in a vane assembly includes the steps of resisting a first radial load in a first radial direction with a first thrust surface on a thrust projection on a rotatable airfoil and resisting a second radial load in a second radial direction with a second thrust surface on the thrust projection on the rotatable airfoil. The first thrust surface and the second thrust surface are located on a thrust projection spaced from an airfoil.

In a further embodiment of any of the above, the first thrust surface and the second thrust surface are each in contact with a radially inner platform and a retention platform.

In a further embodiment of any of the above, the vane assembly includes a fixed airfoil portion that has a leading edge and a trailing edge. The rotatable airfoil includes a leading edge and a trailing edge. The rotatable airfoil and the fixed airfoil portion form a single vane.

DETAILED DESCRIPTION

Figure 1:
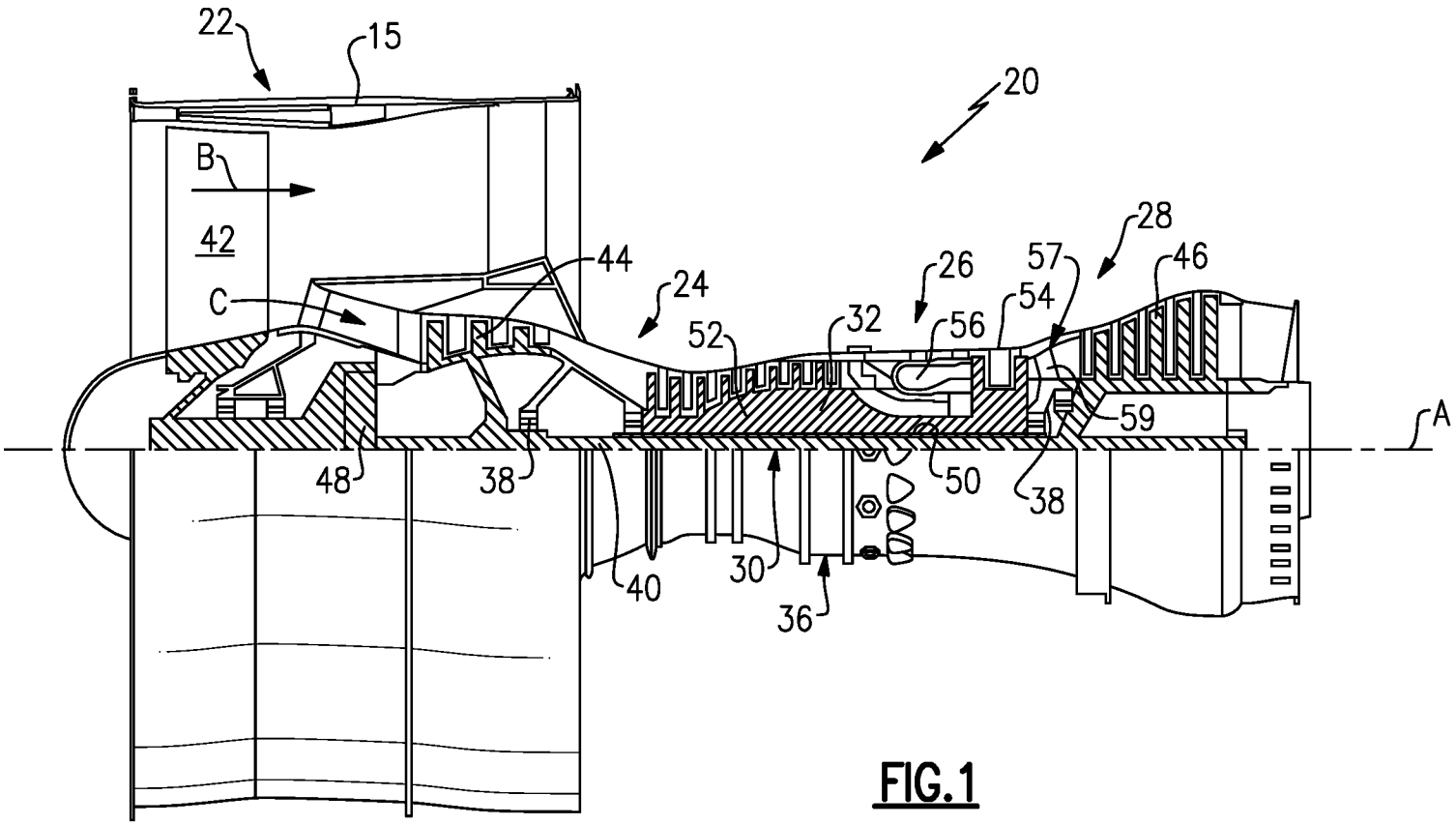
FIG. 1 is a schematic view of an example gas turbine engine according to a first non-limiting embodiment.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram °R)/(518.7°R)]0.5. The "Low corrected fan tip speed" as disclosed herein according to one non-limiting embodiment is less than about 1150 ft/second (350.5 meters/second).

Figure 2:
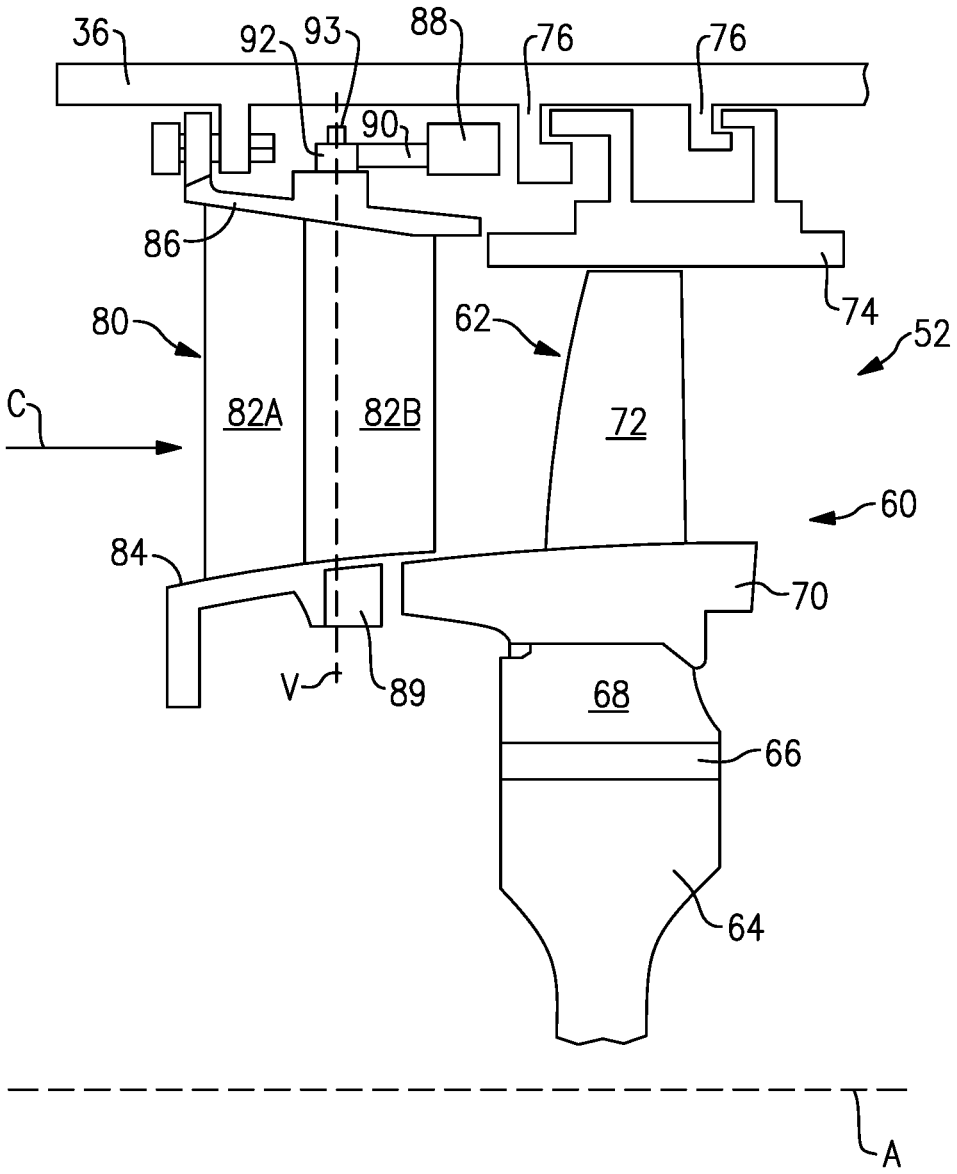
FIG. 2 is a schematic view of a portion of a compressor section.

FIG. 2 illustrates an enlarged schematic view of the high pressure compressor 52, however, other sections of the gas turbine engine 20 could benefit from this disclosure, such as the fan section 22 or the turbine section 28. In the illustrated example, the high pressure compressor 52 includes multiple stages (See FIG. 1). However, the illustrated example in FIG. 2 only shows a single stage of the high pressure compressor 52 and a first rotor assembly 60.

The first rotor assembly 60 includes a plurality of first rotor blades 62 circumferentially spaced around a first disk 64 to form an array. Each of the plurality of first rotor blades 62 include a first root portion 68, a first platform 70, and a first airfoil 72. Each of the first root portions 68 are received within a respective first rim 66 of the first disk 64. The first airfoil 72 extends radially outward toward a blade outer air seal (BOAS) 74. The BOAS 74 is attached to the engine static structure 36 by retention hooks 76 on the engine static structure 36. The plurality of first rotor blades 62 are disposed in the core flow path C. The first platform 70 separates a gas path side inclusive of the first airfoils 72 and a non-gas path side inclusive of the first root portion 68.

In the illustrated example, a plurality of vanes 80 are located axially upstream of the plurality of first rotor blades 62. Each of the plurality of vanes 80 includes a fixed airfoil portion 82A and a rotatable or variable airfoil portion 82B.

However, in another example, the plurality of vanes 80 could be located downstream of plurality of first rotor blades 62.

Figure 4:
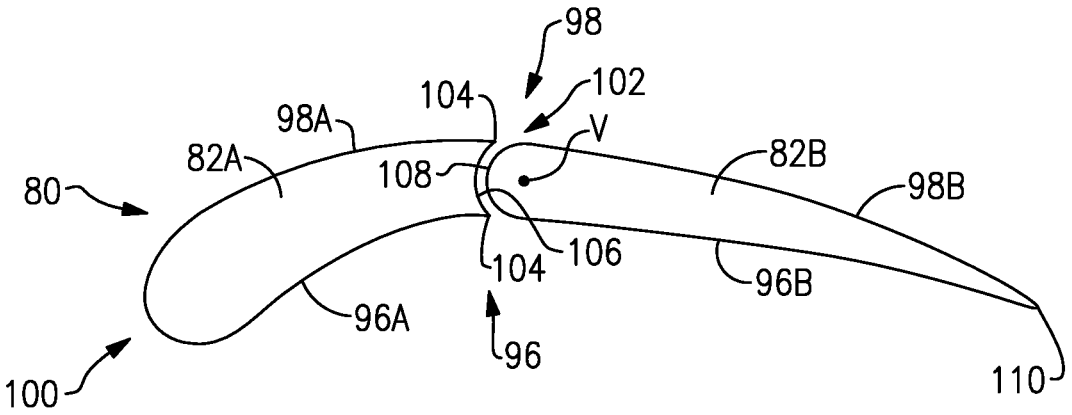
FIG. 4 is a cross-sectional view along line 4-4 of FIG. 3.

In the illustrated example, the fixed airfoil portion 82A is located immediately upstream of the rotatable airfoil portion 82B such that the fixed airfoil portion 82A and the rotatable airfoil portion 82B form a single vane 80 of the plurality of vanes 80. However, in another example, the rotatable airfoil portion 82B is used without the fixed airfoil portion 82A such that the rotatable airfoil portion 82B forms the singe vane 80. The rotatable airfoil portion 82B rotates about an axis V as shown in FIGS. 2 and 4.

A radially inner platform 84 and a radially outer platform 86 extend axially along radially inner and outer edges of each of the vanes 80, respectively. In the illustrated example, the radially outer platform 86 extends along the entire axial length of the fixed airfoil portion 82A and the rotatable airfoil portion 82B and the radially inner platform 84 extends along the entire axial length of the fixed airfoil portion 82A and along at least a portion of the axial length of the rotatable airfoil portion 82B. Also, the rotatable airfoil portion 82B moves independently of the radially inner platform 84 and the radially outer platform 86. In this disclosure axial or axially, radial or radially, and circumferential or circumferentially is in relation to the engine axis A unless stated otherwise.

A variable pitch driver 88 is attached to a radially outer projection 92 on a radially outer end of the rotatable airfoil portion 82B through an armature 90. The radially outer projection 92 includes a cylindrical cross section. The armature 90 rotates the radially outer projection 92 about the axis V to position the rotatable airfoil portion 82B about the axis V. The variable pitch driver 88 include at least one actuator that cause movement of the armature 90 to rotate the radially outer projection 92 and cause the rotatable airfoil portion 82B to rotate.

Figure 3:
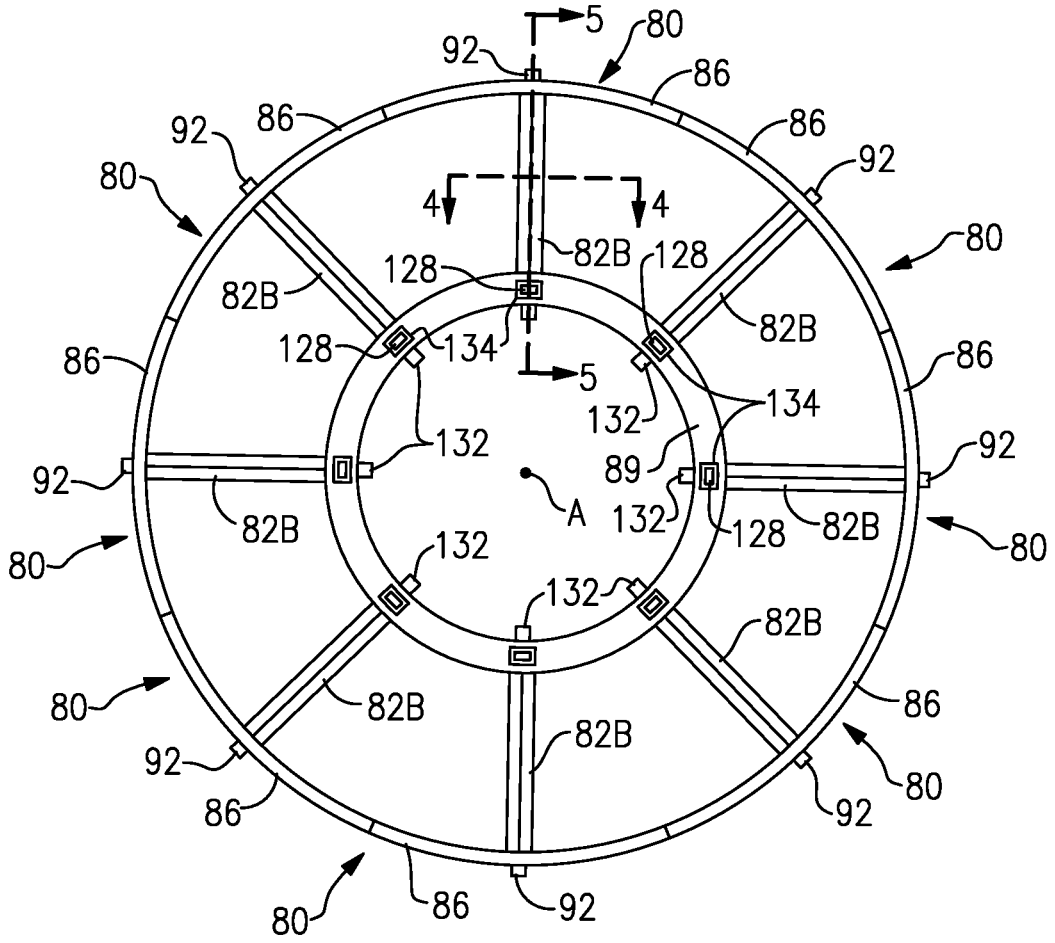
FIG. 3 is an axially forward facing view of a plurality of vanes.

As shown in FIGS. 2 and 3, the plurality of vanes 80 are circumferentially spaced around the engine axis A. The rotatable airfoil portion 82B is at least partially secured by a retention clamshell 89 located on a radially inner side of each of the plurality of vanes 80 and a pivotable connection formed between the radially outer projection 92 and an opening 94 (see FIG. 5) through the radially outer platform 86.

As shown in FIG. 4, the vane 80 includes a pressure side 96 and a suction side 98. The fixed airfoil portion 82A includes a pressure side portion 96A and a suction side portion 98A. Similarly, the rotatable airfoil portion 82B includes a pressure side portion 96B and a suction side portion 98B. The pressure side portions 96A, 96B collectively form the pressure side 96 of the vane 80 and the suction side portions 98A, 98B collectively form the suction side 98 of the vane 80.

The fixed airfoil portion 82A includes a leading edge 100 and a trailing edge 102. The trailing edge 102 includes edges 104 at the pressure side portion 96A and the suction side portion 98A that are connected by a concave surface 106. The rotatable airfoil portion 82B also includes a leading edge 108 and a trailing edge 110. The leading edge 108 of the rotatable airfoil portion 82B includes a curved profile that follows a curved profile of the concave surface 106 on the trailing edge 102 of the fixed airfoil portion 82A.

Figure 5:
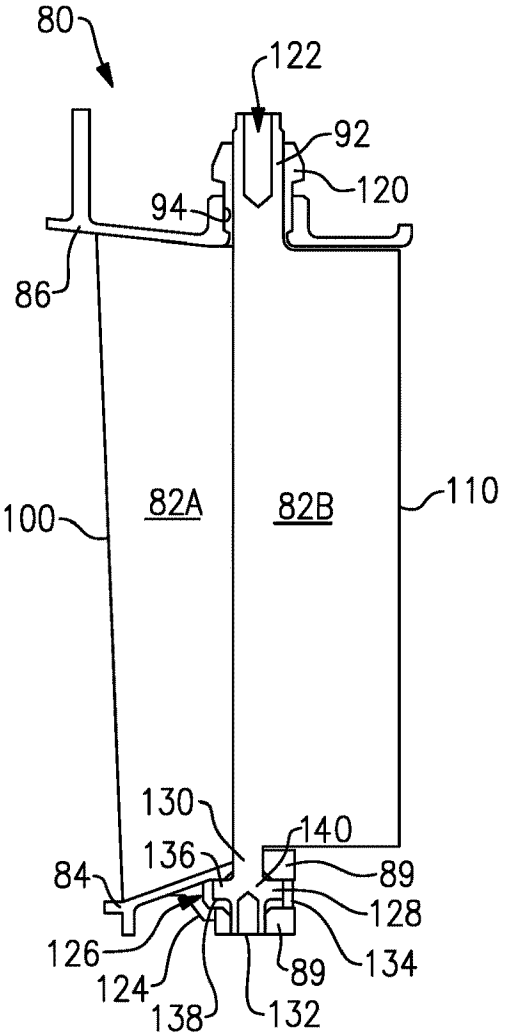
FIG. 5 is a cross-sectional view along line 5-5 of FIG. 3.

FIG. 5 illustrates a cross-sectional view of the vane 80 along line 5-5 of FIG. 3. As shown in FIG. 5, the radially outer platform 86 includes the opening 94 for accepting the projection 92 on the rotatable airfoil portion 82B. In the illustrated example, a bushing 120 at least partially spaces the rotatable airfoil portion 82B from the radially outer platform 86 and reduces gases from the core flow path C from traveling through the radially outer platform 86. The projection 92 also includes a fastener opening 122 for accepting a fastener 93 (FIG. 2) for securing the armature 90 (FIG. 2) to the rotatable airfoil portion 82B.

As shown in FIG. 5, the retention clamshell 89 secures the rotatable airfoil portion 82B to the radially inner platform 84. The radially inner platform 84 includes a protrusion 124 that extends radially inward and defines a recess 126. The recess 126 accepts a thrust projection 128 located on a radially inner end of the rotatable airfoil portion 82B. The recess 126 creates an open space to allow the thrust projection 128 to rotate freely on the projection 124 extending from the radially inner platform 84.

In the illustrated example, a radially inward directed protrusion 130 extends radially inward from the rotatable airfoil portion 82B and spaces the thrust projection 128 from the rotatable airfoil portion 82B. A pivoting projection 132 is located on an opposite side of the thrust projection 128 from the radially inward directed protrusion 130. The radially inward directed protrusion 130 is located axially between the protrusion 124 and a portion of the retention clamshell 89. In the illustrated example, the thrust projection 128 includes a radius relative to the axis V that is larger than a radius for both the pivoting projection 132 and the radially inward directed protrusion 130.

As shown in FIGS. 3 and 5, the retention clamshell 89 forms a one piece continuous ring that includes projection openings 134 circumferentially spaced around the retention clamshell 89 for accepting a portion of the thrust projection 128. The projection openings 134 extend completely through the retention clamshell 89 from an axially upstream side to an axially downstream side of the retention clamshell 89. In the illustrated example, the projection openings 134 and the recess 126 create an open space to allow the thrust projection 128 to rotate freely on the retention clamshell 89 and the protrusion 124, respectively.

Figure 7:
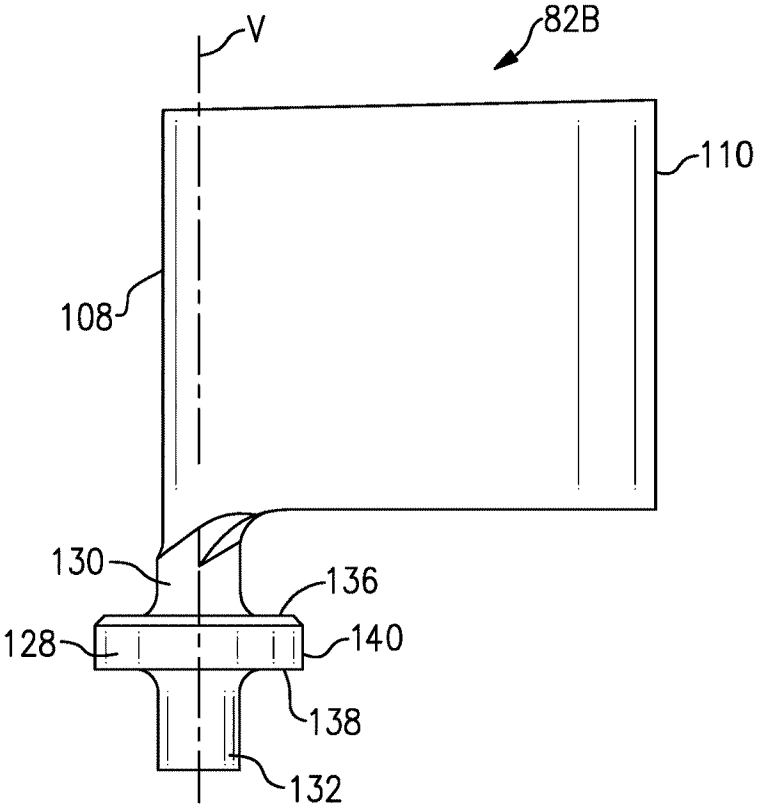
FIG. 7 is an enlarged view of the rotatable airfoil portion of FIG. 6.
Figure 6:
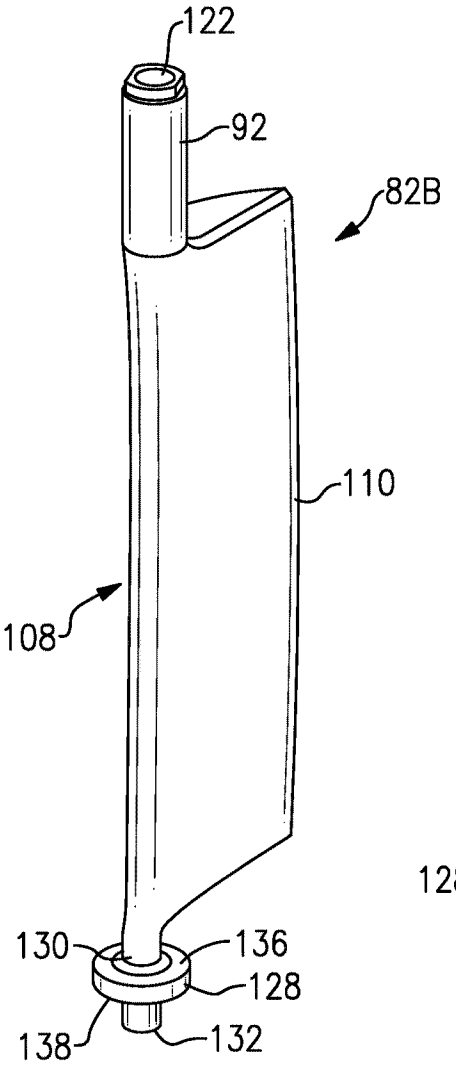
FIG. 6 is a perspective view of a rotatable airfoil portion.

As shown in FIGS. 5-7, the thrust projection 128 includes a radially outer surface 136 and a radially inner surface 138. The radially outer surface 136 functions as a thrust surface to support radially outward loads on the rotatable airfoil portion 82B. Similarly, the radially inner surface 138 functions as a thrust surface to support radially inward loads on the rotatable airfoil portion 82B. The radially inner surface 138 and the radially outer surface 136 are connected by a cylindrical portion 140. The thrust projection 128, the radially inward directed projection 130, and the pivoting projection 132 are centered about the axis of rotation V of the rotatable airfoil portion 82B. The cylindrical portion 140 is also at least partially radially aligned with the projection openings 134 in the retention clamshell 89.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A vane assembly comprising:

a rotatable airfoil extending between a radially inner platform and a radially outer platform having a leading edge and a trailing edge;

a radially inward directed protrusion extending radially inward from the rotatable airfoil;

a thrust projection fixed relative to the rotatable airfoil and located radially inward from the radially inward directed protrusion, wherein the thrust projection includes a first thrust surface for supporting radial loads in a first radial direction and a second thrust surface for supporting radial loads in a second radial direction and the first or second thrust surface encircles a perimeter of the radially inward directed protrusion and the thrust projection includes a relatively constant outer diameter; and a pivoting projection located on an opposite side of the thrust projection from the radially inward directed protrusion.

2. The vane assembly of claim 1, wherein the rotatable airfoil is rotatable about an axis that extends through the rotatable airfoil and a center of the thrust projection.

3. The vane assembly of claim 2, wherein the first thrust surface is a radially outer surface and the second thrust surface is a radially inner surface and the first thrust surface is connected to the second thrust surface by a cylindrical portion and the first and second thrust surfaces each form a ring between cylindrical portion and the radially inward directed protrusion.

4. The vane assembly of claim 2, further comprising a radially outer projection on the rotatable airfoil having a cylindrical cross-section.

5. The vane assembly of claim 4, wherein the radially outer projection extends through an opening in at least one of the radially outer platform or an engine case, the rotatable airfoil is rotatable relative to the radially outer platform and the radially inner platform, and the radially outer projection and the thrust projection are integral and single piece with the rotatable airfoil.

6. The vane assembly of claim 5, further comprising a pivoting projection located radially inward from the thrust projection forming an integral single piece component with the thrust projection.

7. The vane assembly of claim 1, further comprising a fixed airfoil portion extending between the radially inner platform and the radially outer platform having a leading edge and a trailing edge, wherein the rotatable airfoil is located aft of the fixed airfoil portion and the trailing edge of the fixed airfoil portion includes a concave surface.

8. The vane assembly of claim 7, wherein the trailing edge of the fixed airfoil portion includes a first edge adjacent a pressure side of the fixed airfoil portion and a second edge adjacent a suction side of the fixed airfoil portion and the first edge and the second edge define boundaries of the concave surface.

9. The vane assembly of claim 8, wherein the leading edge of the rotatable airfoil is convex and follows a profile of the concave surface on the fixed airfoil portion.

10. A gas turbine engine comprising:

a compressor section driven by a turbine section, wherein the compressor section includes a vane assembly having:

a rotatable airfoil extending between a radially inner platform and a radially outer platform having a leading edge and a trailing edge;

a thrust projection fixed relative to the rotatable airfoil, wherein the thrust projection includes a first thrust surface for supporting radial loads in a first radial direction and a second thrust surface for supporting radial loads in a second radial direction, wherein the first thrust surface is connected to the second thrust surface by a cylindrical portion and the first and second surfaces each form a ring and the thrust projection includes a relative constant outer diameter; and a pivoting projection located on an opposite side of the thrust projection from the rotatable airfoil.

11. The gas turbine engine of claim 10, wherein the rotatable airfoil is rotatable about an axis that extends through the rotatable airfoil and a center of the thrust projection.

12. The gas turbine engine of claim 11, wherein the first thrust surface is a radially outer surface and the second thrust surface is a radially inner surface.

13. The gas turbine engine of claim 12, further comprising a radially outer projection on the rotatable airfoil having a cylindrical cross-section.

14. The gas turbine engine of claim 13, wherein the radially outer projection extends through an opening in at least one of the radially outer platform or an engine case, the rotatable airfoil is rotatable relative to the radially outer platform and the radially inner platform, and the radially outer projection and the thrust projection are integral with the rotatable airfoil.

15. The gas turbine engine of claim 10, further comprising a fixed airfoil portion extending between the radially inner platform and the radially outer platform having a leading edge and a trailing edge, wherein the rotatable airfoil is located aft of the fixed airfoil portion, the trailing edge of the fixed airfoil portion includes a concave surface, the trailing edge of the fixed airfoil portion includes a first edge adjacent a pressure side of the fixed airfoil portion and a second edge adjacent a suction side of the fixed airfoil portion, and the first edge and the second edge define boundaries of the concave surface.

16. The gas turbine engine of claim 15, wherein the leading edge of the rotatable airfoil is convex and follows a profile of the concave surface on the fixed airfoil portion.

17. The gas turbine engine of claim 10, further comprising a radially inward directed protrusion extending radially inward from the rotatable airfoil with the thrust projection located radially inward from the radially inward directed protrusion with one of the first or second thrust surfaces encircles a perimeter of the radially inward directed protrusion and the radially outer projection and the thrust projection are integral with the rotatable airfoil.

18. A method of controlling radial loads in a vane assembly comprising the steps of:

resisting a first radial load on the vane assembly in a first radial direction with a first thrust surface forming a ring on a thrust projection on a rotatable airfoil; and resisting a second radial load in a second radial direction with a second thrust surface forming a ring on the thrust projection on the rotatable airfoil, wherein the first thrust surface and the second thrust surface are located on a thrust projection having a relatively constant outer diameter and spaced from an airfoil, and a pivoting projection is located on an opposite side of the thrust projection from the airfoil.

19. The method of claim 18, wherein the first thrust surface and the second thrust surface are each in contact with a radially inner platform and a retention clam shell.

20. The method of claim 19, wherein the vane assembly includes a fixed airfoil portion having a leading edge and a trailing edge, the rotatable airfoil includes a leading edge and a trailing edge, and the rotatable airfoil and the fixed airfoil portion form a single vane.

* * * * *